United States Patent [19]

Abe et al.

[11] 4,412,781

[45] Nov. 1, 1983

[54] VORTEX BLOWER

[75] Inventors: Masahiro Abe, Chiba; Masayuki Fujio, Yachio, both of Japan

[73] Assignee: Hitachi Ltd., Tokyo, Japan

[21] Appl. No.: 285,554

[22] Filed: Jul. 21, 1981

[30] Foreign Application Priority Data

Jul. 21, 1980 [JP] Japan ..... 55-98755

[51] Int. Cl.[3] ..... F04D 29/66

[52] U.S. Cl. ..... 415/53 R; 415/53 T; 415/119; 415/213 T

[58] Field of Search ..... 415/53 R, 53 T, 119, 415/213 T

[56] References Cited

U.S. PATENT DOCUMENTS

| | | | |
|---|---|---|---|
| 2,632,394 | 3/1953 | Andrews | 415/119 |
| 3,002,341 | 10/1961 | Muzzy | 415/119 |
| 3,324,799 | 6/1967 | Terrano | 415/53 T |
| 3,355,095 | 11/1967 | Hollenberg | 415/53 T |

*Primary Examiner*—Harvey C. Hornsby
*Assistant Examiner*—John Kwon
*Attorney, Agent, or Firm*—Antonelli, Terry & Wands

[57] ABSTRACT

A vortex blower including a casing, an annular air passageway defined in the casing, an impeller mounted for rotation in the casing, a partition wall, a suction port and a discharge port disposed on both sides of the partition wall and communicated with each other through the annular air passageway, and an extension wall formed by extending at least one wall surface of the partition wall along a surface of rotation of the impeller, the extension wall tapering in going toward its forward end. The blower is further formed with at least one projecting wall continuous with the partition wall and an inner wall surface of the air passageway in the vicinity of the partition wall, for shutting off the noise produced in the vicinity of the partition wall and preventing it from being transmitted to outside to thereby reduce the noise produced by the blower.

14 Claims, 6 Drawing Figures

VORTEX BLOWER

BACKGROUND OF THE INVENTION

1. Field of the Invention

This invention relates to a vortex blower of an improved construction formed with at least one projecting wall extending into the suction port or discharge port for reducing noise.

2. Description of the Prior Art

In one type of vortex blower of the prior art, the suction port and the discharge port are arranged on both sides of a partition wall and are communicated with each other by an annular air passageway in a casing in which the impeller is located. This type of vortex blower has had the problem that noise is produced in the vicinity of the partition wall. This problem has been believed to stem from the fact that a sudden change in pressure occurs in the vicinity of the partition wall each time a blade of the impeller passes by the partition wall and that the drawn air vigorously impinges on the impeller on the suction side while the air of increased pressure that has flowed through the air passageway vigorously impinges on the partition wall on the discharge side.

To obviate this problem, Japanese Utility Model Registration No. 967175 (Utility Model Publication No. 31322/71) has been proposed. In this proposal, the a portion of the partition wall, particularly the forward end of its central portion, projects greatly in such a manner that its thickness gradually becomes smaller in a direction extending away from the partition wall and the surface thereof facing the impeller gradually becomes smaller in size, so that the partition wall has extension walls in the form of a triangular vane. The provision of extension walls of this shape enables the noise produced to be reduced to a certain extent because the direction in which the air current flows can be gradually varied in the vicinity of the partition wall and the change in pressure in this zone can be reduced. However, this construction has been unable to achieve the desired results and improvements have been pined sought after.

SUMMARY OF THE INVENTION

This invention has as its object the provision of a vortex blower formed with an improved partition wall for preventing noise that might otherwise be produced in the vicinity of the partition wall.

In accordance with one advantageous feature of the invention, in a vortex blower including an impeller located in a casing formed with a suction port and a discharge port located on both sides of the partition wall and communicated with each other by an annular air passageway, with a partition wall having extension walls extending therefrom along a surface of rotation of the impeller, at least one projecting wall connects the partition wall to an inner wall surface of the air passageway in the vicinity of the partition wall.

DESCRIPTION OF THE PREFERRED EMBODIMENTS

It is believed that the inability of the aforementioned Japanese Utility Model Registration No. 967175 to achieve satisfactory results in reducing noise is attributed to the following. Although this utility model is capable of reducing a change in the direction of the air current or its pressure in the central portion of the air passageway by the action of the extensions of the partition wall, a violent change in pressure still occurs on opposite sides of the partition wall, particularly in the skirts of its extensions when a blade of the impeller passes thereby. This change in pressure would cause a noise to be produced. The noise produced in this way would be transmitted directly to the suction port or the discharge port or indirectly through the partition wall.

To prevent the noise produced in the vicinity of the partition wall from being transmitted to the suction port or the discharge port, in accordance with the present invention at least one projecting wall is formed which extends from the wall surface of the air passageway in the vicinity of at least one of the suction port or the discharge port, to cut off the transfer of noise from a noise source to the suction port and/or the discharge port.

Figure 1:
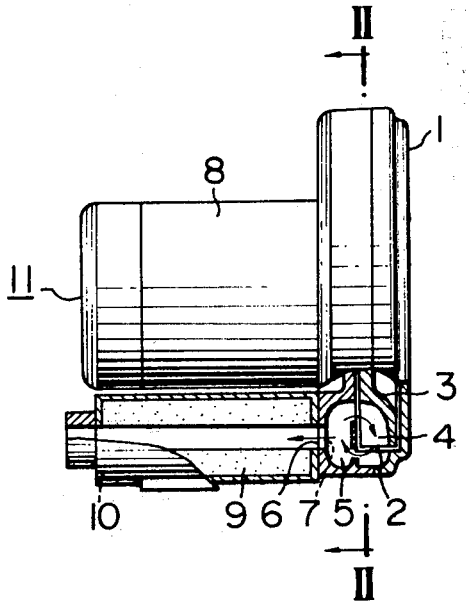
FIG. 1 is a partial cross-sectional schematic view a vortex blower constructed in accordance with one embodiment of the invention.

As shown in FIG. 1 a vortex blower 11 includes a casing 1 formed with an annular air passageway 2, supporting an impeller 3 for rotation therein. The impeller 3 is constructed such that its end surface forms a part of the inner wall surface of the air passageway 2 extending from its inner side to its outer side. The impeller 3 is provided with a plurality of blades 4 radially mounted in a portion thereof facing the air passageway 2. A partition wall 5 includes a portion of the casing 1 extending into the air passageway 2 to define a starting end and a terminating end in the air passageway 2. A suction port 6 and a discharge port 7 for the air are respectively located on a suction and discharge side of the partition wall 5 for communication with the air passageway 2. An electric motor 8 is disposed in the casing 1 for driving the impeller 3. Mufflers 9 and 10 are arranged below the electric motor 8 for connection to the suction port 6 and the discharge port 7 of the casing 1, respectively.

The vortex blower 11 of the aforesaid construction operates as follows. The air drawn through the suction port 6 into the air passageway 2 in the casing 1 is given energy by the impeller 3 while flowing through the annular air passageway 2 and has its pressure rise to a high level, and the high pressure air is exhausted through the muffler 10 and the discharge port 7. The mufflers 9 and 10 have their forward ends connected to various tubes, not shown, or directly open in the atmosphere.

Figure 2:
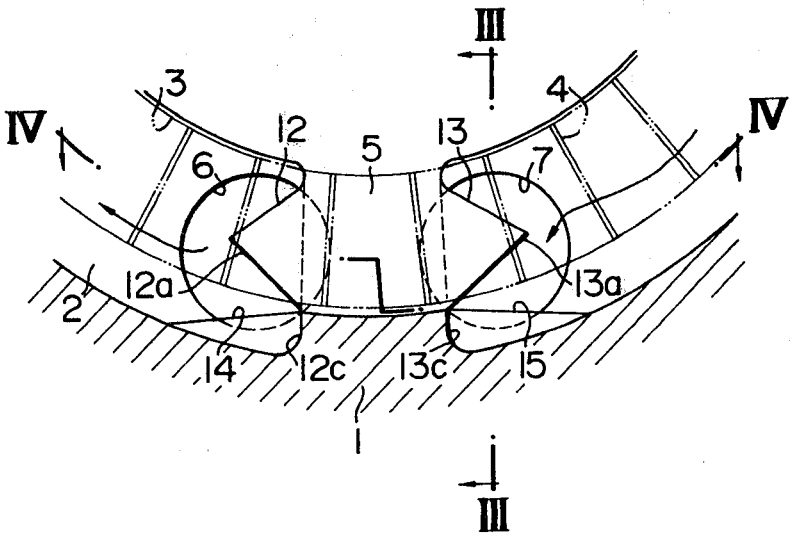
FIG. 2 is a cross-sectional view, on an enlarged scale, taken along the line II—II in FIG. 1, showing details of the construction shown in FIG. 1.
Figure 3:
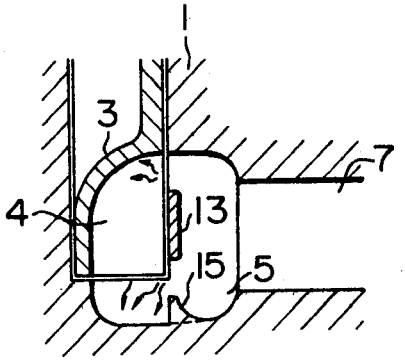
FIG. 3 is a cross-sectional view taken along the line III—III in FIG. 2.
Figure 4:
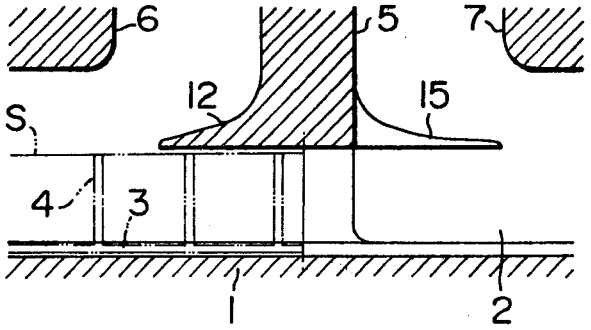
FIG. 4 is a cross-sectional view taken along the line IV—IV in FIG. 2.

The construction and operation of the vortex blower 11 will be described further in detail by referring to FIGS. 2–4. As shown in FIGS. 2–4, the partition wall 5 is formed with extension walls 12 and 13 extending along a surface S of rotation of the impeller 3 in such a manner that their thicknesses gradually become smaller in a direction extending outwardly from the partition wall 5. More particularly, the forward end of the central portion of the partition wall 5 greatly extends so that the surface thereof facing the impeller 3 becomes gradually smaller, to give a triangular vane shape to the extension walls 12 and 13 of the wall 5. When the partition forward end of the partition wall 5 has this construction, it is possible to cause a change in pressure to take place slowly at forward end portions 12*a* and 13*a* of the triangular vane shape extension walls 12 and 13 of the partition wall 5. A projecting wall 14 extends from the inner wall surface of the air passageway 2 along the surface S of rotation of the impeller 3 on the suction port 6 side of the partition wall 5. The projecting wall 14 starts at a bottom 12*c* of the outer side of the extension wall 12 and extends from the inner wall surface of the air passageway 2 into the air passageway 2 in such a manner that its height and thickness, as measured from the inner wall surface of the air passageway 2, become gradually smaller as it extends deeper into the air passageway 2. Likewise, a projecting wall 15 starts at a bottom 13*c* of the outer side of the wall 13 and extends from the inner wall surface of the air passageway 2 into the air passageway 2 in such a manner that its height and thickness become gradually smaller as it extends deeper into the air passageway 2. These two projecting walls 14 and 15 are constructed such that the surfaces opposite the impeller 3 are gradually spaced apart a larger distance from the surface S of rotation of the impeller 3 as they become closer to the partition wall 5, to enable the projecting walls 14 and 15 to be connected with the inner wall surface of the partition wall 5 and the air passageway 2 by gently sloping surfaces. When the vortex blower 11 is operated, the direction of the air passageway 2 is gradually changed along the projecting walls 14 and 15 at not only the forward ends 12*a* and 13*a* of the triangular vane shape extension walls 12 and 13 of the partition wall 5 but also the bottoms 12*c* and 13*c* thereof. By virtue of this structural feature, a sudden change in pressure that might occur on both sides of the partition wall 5 can be reduced and production of noise can be avoided. At the same time, as shown in FIG. 3, part of the noise produced by the partition wall 5 is cut off and prevented from being directly transmitted to the suction port 6 or the discharge port 7. The noise cut off by the projecting walls 14 and 15 is reflected by the projecting walls 14 and 15 and attenuated as it is reverberated by the walls of the air passageway 2. Thus, the embodiment is capable of reducing the noise of high frequency level which is most offensive to the ear. Test results show that the vortex blower 11 provided with the projecting walls 14 and 15 according to the invention is capable of reducing noise by about 5 dB (A scale) as compared with a vortex blower merely formed with the extension walls 12 and 13 of the partition wall 5.

Figure 5:
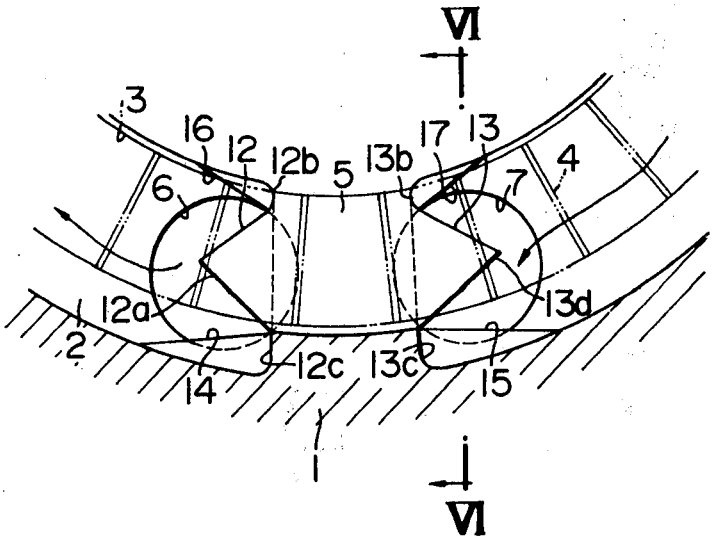
FIG. 5 is a partial cross-sectional view of a vortex blower constructed in accordance with another embodiment of the present invention.
Figure 6:
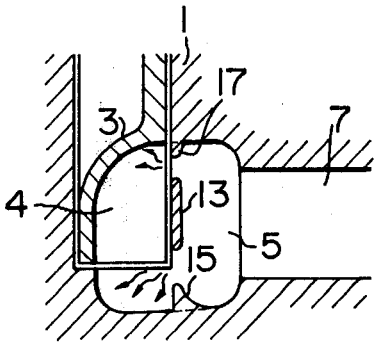
FIG. 6 is a cross-sectional view taken along the line VI—VI in FIG. 5.

As shown in FIGS. 5 and 6, additional projecting walls 16 and 17 may be provided, with the projecting wall 16 extending from the inner wall surface of the air passageway 2 along the surface S of rotation of the impeller 3 on the suction port 6 side of the partition wall 5. The projecting wall 16 starts at a bottom 12*b* of the inner side of the extension wall 12 of the partition wall 5 and extends from the inner wall surface of the air passageway 2 into the air passageway 2, and has its height and thickness gradually reduced as it extends deeper into the air passageway 2. Likewise, the projecting wall 17 starts at a bottom 13*b* of the inner sides of the extension wall 13 of the partition wall 5 on the discharge port 7 side thereof and extends into the air passageway 2, and has its height and thickness gradually reduced as it extends from the inner wall surface of the air passageway 2 deeper into the air passageway 2. Like the projecting walls 14 and 15, the projecting walls 16 and 17 are constructed such that the surfaces opposite the impeller 3 are gradually spaced apart a larger distance from the surface S of rotation of the impeller as they become closer to the partition wall 5, to enable the projecting walls 16 and 17 to be connected with the inner wall surface of the partition wall 5 and the air passageway by gently sloping surfaces. When the vortex blower of FIGS. 5 and 6 is operated, the noise produced on the inner side of the partition wall 5 is cut off by the projecting walls 16 and 17, so that less noise is transmitted directly to the suction port 6 or the discharge port 7 after being produced in the vicinity of the partition wall 5 and the noise produced by the vortex blower can be further reduced.

In the embodiments shown and described hereinabove, the extension walls 12, 13 and projecting walls 14, 15 and/or 16, 17 have been described as being provided on opposite wall surfaces of the partition wall 5. It is to be understood, however, the projecting walls 14, 15, 16, 17 on one or the other wall surface of the partition wall 5 may be dispensed with when the effect of silencing noise can be achieved by a piping connected to the suction port or the discharge port. More specifically, when the vortex blower 11 is used as an air blower by opening the suction side while connecting a pipe to the discharge side, the projecting walls 15 and/or 17 on the discharge port side can be eliminated. When the vortex blower is used as a suction blower by opening the discharge port while connecting a pipe to the suction port, the projecting walls 14 and/or 16 on the suction port side can be eliminated.

From the foregoing description, it will be appreciated that the present invention provides, in a vortex blower of the type in which extension walls 12, 13 of a triangular vane shape continuous with the partition wall 5 partitioning the air passageway extends along the surface S of rotation of the impeller 3, projecting walls 14, 15, 16, 17 contiguous with the skirts of the extension walls 12, 13 and extending along the inner wall surface of the air passageway 2 in the vicinity of the skirts or the suction port 6 and the discharge port 7 into the air passageway 2. By virtue of the projecting walls 14, 15, 16, 17, the invention is capable of cutting off noise produced in the vicinity of the partition wall 5 and preventing it from being transmitted to outside. Thus, the invention enables a vortex blower of less noise released to outside to be obtained.

What is claimed is:

1. A vortex blower comprising:

a casing;

an annular air passageway defined in said casing;

an impeller means mounted for rotation in said casing;

a partition wall means extending into said annular air passageway in a direction of said impeller to arcuately partition said annular passageway;

a suction port and a discharge port respectively disposed on a suction side and a discharge side of said partition wall means, said suction port and discharge port being in communication with each other through said annular air passageway;

an extension wall formed by extending at least one wall surface of said partition wall means along a surface of rotation said impeller, said extension wall tapering in a direction extending outwardly from the partition wall means; and at least one projecting wall extending into the annular passageway is connected to said at least one wall surface of said partition wall means and connected to an inner wall surface of the air passageway in a vicinity of said partition wall means.

2. A vortex blower as claimed in claim 1, wherein a height of said projection wall, as measured from the inner wall surface of the air passageway, is gradually reduced in a direction extending outwardly from the partition wall means into the air passageway.

3. A vortex blower as claimed in claim 2, wherein said projecting wall has a side surface located along an extension of the surface of rotation of the impeller means.

4. A vortex blower as claimed in claim 3, wherein said projecting wall is located on an outer side of the extension wall.

5. A vortex blower as claimed in claim 3, wherein two projecting walls are provided, one of said projecting walls being located on an outer side of the extension wall, and the other of said projecting walls being located on an inner side of the extension wall.

6. A vortex blower as claimed in claim 1, wherein at least two projecting walls are provided and are respectively disposed on the suction side and discharge side of said partition wall means, each of said projecting walls extending into the annular passageway and being connected to wall surfaces of the partition wall means provided on respective sides thereof and the inner wall surface of the air passageway.

7. A vortex blower as claimed in claim 6, wherein a height of each of the projecting walls, as measured from the inner wall surface of the air passageway, is gradually reduced in a direction extending outwardly from the partition wall means into the air passageway.

8. A vortex blower as claimed in claim 1, wherein said at least one projecting wall is disposed on the suction side of the partition wall means.

9. A vortex blower as claimed in claim 1, wherein the at least one projecting wall is disposed on the discharge side of the partition wall means.

10. A vortex blower as claimed in claim 1, wherein said at least one projecting wall is connected to the wall surface of the partition wall means provided on the suction side, and wherein at least one additional projecting wall is provided, said additional projecting wall being connected to a wall surface of the partition wall means provided on the discharge side of the partition wall means and connected to the inner surface of the air passageway.

11. A vortex blower as claimed in claim 10, wherein a further projecting wall is provided on the suction side of the partition wall means, said further projecting wall being connected to a wall surface of the partition wall means disposed on the suction side and to the inner wall surface of the annular air passageway at a position spaced radially inwardly from said at least one projecting wall.

12. A vortex blower as claimed in claim 10, wherein at least two further projecting walls are provided and are respectively disposed on the suction and discharge side of the partition wall means, said two further projecting walls being respectively connected to wall surfaces of the partition wall means disposed on the suction and discharge side and to the inner surface of the annular air passageway at positions spaced radially inwardly from said at least one projecting wall and said at least one additional wall, respectively.

13. A vortex blower as claimed in claim 1, wherein said at least one projecting wall is disposed on the discharge side of the partition wall means, and wherein a further projecting wall is provided on the discharge side of the partition wall means, said further projecting wall being connected to a wall surface of the partition wall means disposed on the discharge side and to the inner wall surface of the annular air passageway at a position spaced radially inwardly from said at least one projecting wall.

14. A vortex blower as claimed in claim 1, wherein said at least one projecting wall is disposed on the suction side of the partition wall means, and wherein a further projecting wall is provided on the suction side of the partition wall means, said further projecting wall being connected to a wall surface of the partition wall means disposed on the suction side and to the inner wall surface of the annular air passageway at a position spaced radially inwardly from said at least one projecting wall.

* * * * *